US008899045B2

(12) United States Patent
Lenk

(10) Patent No.: US 8,899,045 B2
(45) Date of Patent: Dec. 2, 2014

(54) METHOD OF CONTINUOUSLY CONDITIONING GAS, PREFERABLY NATURAL GAS

(75) Inventor: Andreas Lenk, Wardenburg (DE)

(73) Assignee: EWE Gasspeicher GmbH, Oldenburg (DE)

( * ) Notice: Subject to any disclaimer, the term of this patent is extended or adjusted under 35 U.S.C. 154(b) by 980 days.

(21) Appl. No.: 12/737,588

(22) PCT Filed: May 12, 2009

(86) PCT No.: PCT/DE2009/000665

§ 371 (c)(1),
(2), (4) Date: Jan. 28, 2011

(87) PCT Pub. No.: WO2010/015214

PCT Pub. Date: Feb. 11, 2010

(65) Prior Publication Data

US 2011/0120011 A1 May 26, 2011

(30) Foreign Application Priority Data

Aug. 4, 2008 (DE) ..... 10 2008 036 243

(51) Int. Cl.
*F01K 17/00* (2006.01)
*F23K 5/00* (2006.01)

(52) U.S. Cl.
CPC ..... *F23K 5/002* (2013.01); *F23K 2401/10* (2013.01)
USPC ..... 60/648; 60/643

(58) Field of Classification Search
USPC ..... 60/648
See application file for complete search history.

(56) References Cited

U.S. PATENT DOCUMENTS

| | | | |
|---|---|---|---|
| 3,330,773 | A | 7/1967 | De Hart, Jr. |
| 5,003,782 | A | 4/1991 | Kucerija |
| 6,730,272 | B2 | 5/2004 | Reimert |
| 2005/0095185 | A1 | 5/2005 | Gary |
| 2005/0095186 | A1 | 5/2005 | McGee |
| 2007/0283705 | A1 | 12/2007 | Taylor |

FOREIGN PATENT DOCUMENTS

| | | |
|---|---|---|
| EP | 0 529 474 | 3/1993 |
| EP | 0 635 673 | 1/1995 |
| EP | 0 920 578 | 6/1999 |
| RU | 67236 | 10/2007 |
| SU | 274089 | 9/1970 |

*Primary Examiner* — Matthew Merkling
(74) *Attorney, Agent, or Firm* — Collard & Roe, P.C.

(57) ABSTRACT

Before being fed into a pipe, particularly a network of pipes for the supply of consumers, gas, preferably natural gas, is continuously conditioned. The pressurized gas is removed from a reservoir, expanded, and heated to a predefined temperature before or after the expansion thereof in that a branched-off partial flow of the fed-out natural gas is mixed with oxygen and the resulting burnable gas is catalytically burned. The fed-out gas is heated with the thermal energy that is produced. For this purpose, a partial exhaust gas flow is branched off from a hot exhaust gas flow released during the catalytic combustion and conducted into a first container together with the cold burnable gas. The burnable gas is mixed with the supplied exhaust gas flow in the first container and is heated, and the mixture composed of the exhaust gas and burnable gas preheated in this way is conducted away from the first container into a second container, where it is subjected to the catalytic combustion, the heat of which is used to heat the fed-out gas to be conditioned to the respectively desired temperature.

9 Claims, 1 Drawing Sheet

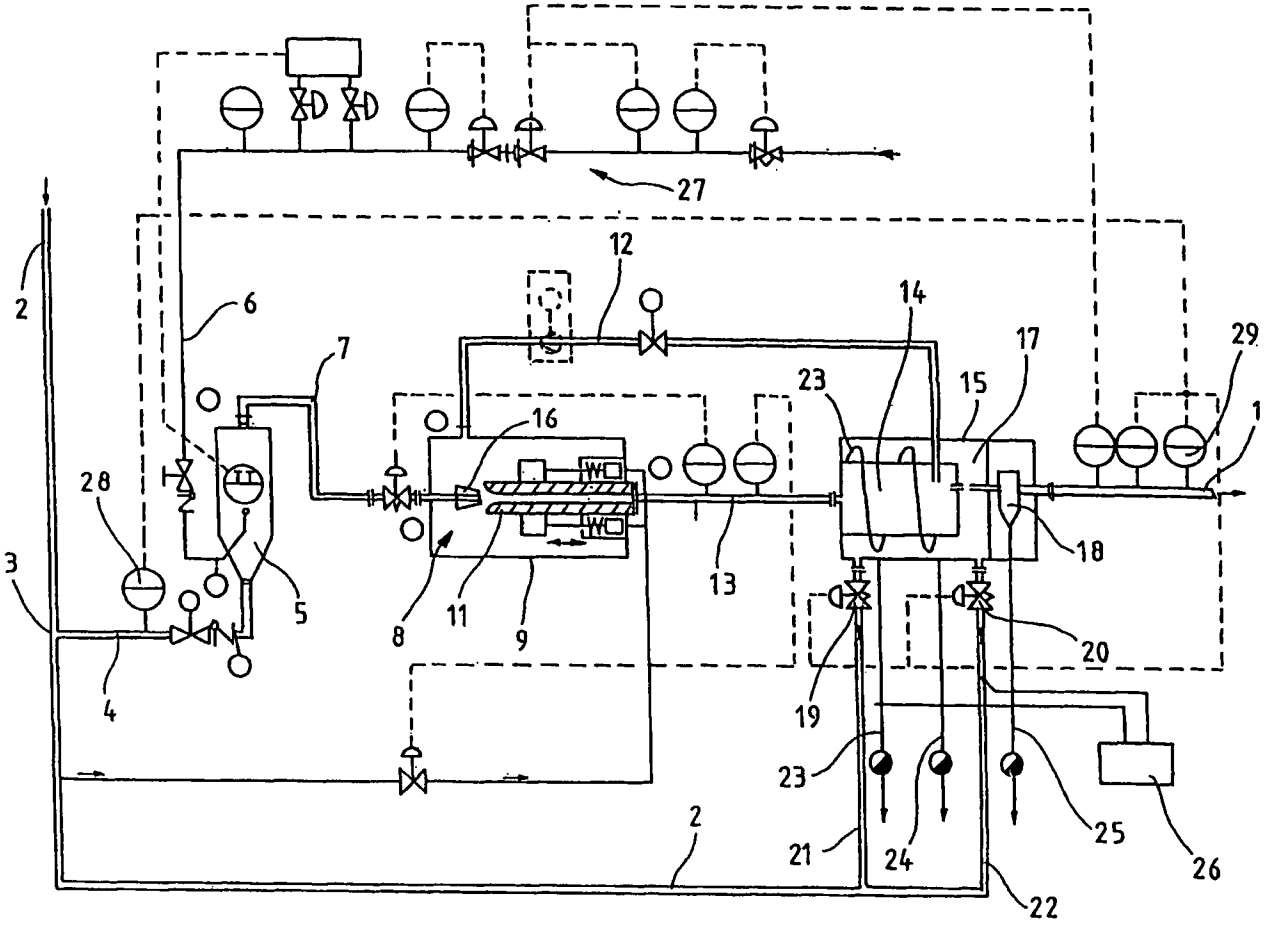
1
2
3
4
5
6
7
8
9
11
12
13
14
15
16
17
18
19
20
21
22
23
24
25
26
27
28
29

METHOD OF CONTINUOUSLY CONDITIONING GAS, PREFERABLY NATURAL GAS

CROSS REFERENCE TO RELATED APPLICATIONS

This application is the National Stage of PCT/DE2009/000665 filed on May 12, 2009, which claims priority under 35 U.S.C. §119 of German Application No. 10 2008 036 243.3 filed on Aug. 4, 2008, the disclosure of which is incorporated by reference. The international application under PCT article 21(2) was not published in English.

The invention relates to a method of continuously conditioning gas, preferably natural gas, before being fed into a pipe, more particularly a network of pipes for supplying consumers, in which the pressurised gas is removed from a reservoir, expanded and heated to a predetermined temperature before or after expansion thereof in that a branched-off partial flow of the fed-out gas is mixed with oxygen and the resulting burnable gas is burned, and in which the fed-out gas is heated with the heat energy that is produced thereby.

When being fed-out from underground reservoirs natural gas must be heated before pressure reduction to compensate for the Joule-Thomson effect. One possibility is a method of the above type which is described in EP 0 920 578. In this the heat required for heating is provided by the catalytic "burning" of part of the fed-out flow in a reactor. In the known method, through the catalytic conversion of oxygen with burnable gas, e.g. natural gas L, in the strongly substoichiometric mixing range, temperatures of up to 400° C. are reached on the catalytic converter directly in the gas flow. The heat is utilised by mixing the hot combustion gases in the form of a partial gas flow with the main gas flow after the reactor. The natural gas fed out from the reservoir has a pressure of 70-150 bars at a temperature of 5-30° C.

The catalytic "combustion" in the reactor requires an activation temperature of at least 180° C.-250° C. In order to reach the temperature the branched-off partial flow of the fed-out gas is mixed with oxygen and catalytically burned. The heat released by this can then be used to heat the fed-out gas to a temperature that is suitable for compensating for the Joule-Thomson effect occurring during expansion and the associated cooling.

In the known method there is always the risk that the reactor, in which the catalytic conversion of the burnable gas takes place with the release of gas, will be cold blown by the low temperatures of the fed-out gas so that the oxygen remains in the burnable gas without being converted. This can be ruled out through heating the burnable gas-oxygen mixture to the catalytic converter activation temperature of 180-250° C. before expansion. Without this preheating the known process quickly becomes imbalanced as the activation temperature in the reactor is not reached. On the other hand, during the addition of oxygen to burnable gas, in this case natural gas, ignition can never be entirely ruled out. The risk actually increases if the oxygen remains in the reactor below the activation temperature as it is not converted. The oxygen concentration increases and therefore also the risk of self-ignition at the high pressures occurring here. Safe implementation of the known method is not guaranteed.

The aim of the invention is to improve the known method is such a way that safe conditioning operation is possible.

This objective is achieved in accordance with the invention by the features described herein. Further developments and advantageous embodiments are set out herein.

The structural implementation of the process in accordance with the invention, utilising the cooling of natural gas during expansion, in the design of the inlets of the expansion valve for cooling and mixing the gas flows before and after the second container (reactor), coupled with dew point measurements at the inlet and outlet for the natural gas into the installation envisaged for implementing the method, allow a specific process for separating water from the natural gas and thereby gas conditioning to be carried out in relation to the water vapour dew point and/or drying of the gas.

The process is also coupled to special separation stages with multiple cyclones and filter elements as well as condensate drains for optimum and safe operation and reduction of contamination with higher hydrocarbon chains of the condensate (water) precipitated from the natural gas.

This represents an essential economic advantage over the known method of gas processing and/or conditioning. The produced condensates are simply separated from hydrocarbons via a downstream filter and can be simply and cost-effectively disposed of.

The user of the method in accordance with the invention also benefits from the compact design of an installation for implementing the method in terms, of space and equipment costs, as all the essential parts of a feed-out installation that can be structurally combined in one device, comprising separators, preheating gas pressure reduction and measurement, gas drying and filtering are already integrated into the process technology.

The absence of movable parts, pumps and similar device reduces the operating and maintenance costs for implementing the method. The combination of catalytic conversion of oxygen and hydrocarbon on the catalytic converter of the reaction container, with expansion directly in the mixing room and/or tangentially to cooling at the inlet around the second container, the reactor, brings about optimum separation of the condensate and condensation of the water vapour out of the catalytic conversion, without the local production of exhaust gases, more particularly with a calculated efficiency of <1.1, making use of the condensation and separation of the water vapour as well as the condensation heat.

The method advantageously utilises the high entry pressure of the natural gas and the usable cooling, due to expansion to supply pipe pressure, to separate the condensates from the natural gas. The method in accordance with the invention is supported by direct preheating in the first container as well as in the area of the in-feeds into the second container through which immediate stopping or suppression of gas hydrate formation can be used. If use of the pressure gradient is not sufficient to achieve complete condensation, as a supportive measure, an absorption agent for binding the water vapour in the natural gas flow can be blown in at the inlet of the main gas flow into second container. The absorption agent, e.g. triethyl glycol, is removed from the conditioning process together with the condensate and can, like the condensate, be collected and subsequently processed whereby it can be reused.

In processing terms the conditioning process is dew point-controlled via the dew point measuring devices installed at the inlet and outlet of the natural gas into the device provided at the natural gas inlet and outlet for implementing the method in accordance with the invention, more particularly through specific variation of the added oxygen and variation of the quantity regulation via the regulating valve of the main gas flow for tangential input via the in-feeds and around the reactor and/or addition directly into the mixing zone/the mixing room between the second container and a downstream separator. In this way the method is particularly safe, especially as the device for adding the oxygen into the mixing container can be provided with a safety system with nitrogen extinguishing.

An example of embodiment of the method in accordance with the invention setting out further inventive features, is shown schematically in the drawing in the form of a flow diagram.

Before being fed into a pipe 1 of a pipe network for supplying consumers, which is not shown, the natural gas to be conditioned is fed out of a reservoir, which is not shown, and flows out of the reservoir via a main line 2. The direction of flow is indicated by arrows, here.

At branch-off point 3 a branch line 4 branches off from the main line 2 via which a partial flow of the fed-out natural gas is taken to a mixing container 5.

Via line 6 oxygen in the gaseous state is fed into the mixing container 5 which in the mixing container 5 mixes with the partial flow of natural gas fed in via the branch line 4.

In the mixing container 5 a burnable gas is thus formed, which is taken via the burnable gas line 7 into the first container 8 with enclosed container walls 9. The first container forms the preheating station which comprises a propelling nozzle 10 and a diffuser 11. Via the propelling nozzle 10 the burnable gas fed in from the burnable gas line 7 at relatively high pressure is injected into the first container 8, whereby the free jet emerging from the propelling nozzle 10, is caught by the diffuser 11 and on its way is mixed and heated with exhaust gas in the container 8 which is supplied via suction line 12 as an exhaust gas partial flow from a catalytic burning process.

The heated burnable gas mixture flows via the mixed line 13 into a reactor chamber 14 of a second container 15 which is designed as a housing which encloses the reactor 14, a mixing chamber 17 and a separator 18.

The jet pump in the first container 8 draws, hot natural gas from the reactor 14 via suction line 12 and mixes it with cold burnable gas flowing out of the mixing container 5.

The cold natural gas entering the housing of the second container 15 via in-feed lines 21 and 22 from the main line 2 with upstream expansion valves, flows around the reactor container 14 whereby it is guided around the reactor container 14 by means of guide elements 23 which are arranged in a spiral fashion around its circumference.

The second container 14 contains a reactor bed in the form of a packing of catalytic granules which are vapour-coated with palladium and/or platinum.

Via the preheating line 13 the preheated burnable gas enters the second container 14. By means of suitable control technology the temperature is adjusted so that an activation temperature of the reactor bed in the second container 14 of around 180° C. to 250° C. is attained.

The burnable as burns catalytically and part of the heat released thereby is transferred via the outer mantle surface to the cold natural gas, being fed in via in-feed lines 21 and 22 and flowing around the second container 14.

Device-related measures are taken so that the natural gas being preheated via the outer mantle surface is mixed with the cold natural gas being fed in via in-feed line 22.

The catalytically burned burnable gases pass from the second container 14 directly into the mixing chamber 17 where they are mixed with the cold natural gas fed in via in-feed line 22.

Through this cooling, on the one hand on the outer mantle surface of the reactor 14, and on the other hand through the hot burnable gases entering the cold natural gas in the mixing chamber 17, immediate hydrate formation takes place with the corresponding separation of condensate, which is removed via the condensate drain lines 23 and 24.

Natural gas which has now been heated, is removed from the mixing chamber 17 and flows through the separator 18, whereby further condensate is separated in the separator 18 and the natural gas is also filtered.

The separator 18 also has a condensate drain 25.

26 denotes a device for supporting condensate separation with which an absorption agent, e.g. triethylene glycol is injected into the gas flow of in-feed lines 21 and 22 to bind the water vapour.

27 denotes a safety device by means of which the oxygen supply 6 is also controlled and regulated.

28 and 29 denote dew point measuring sensors arranged on the inlet and outlet of device for implementing the method. The connection with pressure sensors and temperature sensors are only indicated hereby means of dashed lines.

The invention claimed is:

1. Method of continuously conditioning gas, preferably natural gas, before it is fed into a pipe, more particularly a network of pipes for the supply of consumers, in which pressurized natural gas is removed from a reservoir to form removed pressurized natural gas, wherein the removed pressurized natural gas is expanded and heated to a predetermined temperature before or after its expansion, wherein a branched-off partial flow of the removed pressurized natural gas is mixed with oxygen to produce cold burnable gas, wherein the cold burnable gas becomes heated burnable gas, wherein the heated burnable gas is catalytically burned to produce heat energy, and wherein the heat energy is used to heat the removed pressurized natural gas, wherein a partial exhaust gas flow is branched off from a hot exhaust gas flow released during the catalytic burning and fed together with the cold burnable gas into a first container, wherein the cold burnable gas is mixed with the partial exhaust gas flow in the first container so that the cold burnable gas is heated and so that a mixture is formed comprising heated burnable gas, wherein the heated burnable gas is fed from the first container into a second container in which the goes catalytic burning takes place to produce the heat energy, and wherein the heat energy is used to heat the removed pressurized natural gas to the predetermined temperature.

2. Method in accordance with claim 1, wherein the heated burnable gas is expanded immediately before being fed into the second container.

3. Method in accordance with claim 2, wherein the removed pressurized natural gas is divided into partial flows, at least one of which is fed around a reactor of the second container and at least one further partial flow is fed into a mixing chamber of the second container, whereby at the same time a partial flow of heated natural gas emerging from the reactor is fed into the mixing chamber.

4. Method in accordance with claim 3, wherein a gas flow leaving the mixing chamber is conducted through a separator.

5. Method in accordance with claim 4, wherein condensates occurring in the reactor of the mixing chamber as well as in the separator are directed into a condensate trap.

6. Method in accordance with claim 5, wherein to support condensate separation an absorption agent is injected into the gas flow for binding water vapor.

7. Method in accordance with claim 6, wherein triethylene glycol is used as the absorption agent.

8. Method in accordance with claim 1, wherein the dew point of the removed pressurized natural gas is measured at least before entry into the first container and after leaving the second container, and wherein depending on the measured dew point values, oxygen addition is varied and quantity regulation of natural gas flow fed into the second container takes place.

9. Method in accordance with claim 8, wherein the variation in oxygen addition and quantity regulation are carried out in a program-controlled manner.

* * * * *

UNITED STATES PATENT AND TRADEMARK OFFICE

CERTIFICATE OF CORRECTION

PATENT NO. : 8,899,045 B2
APPLICATION NO. : 12/737588
DATED : December 2, 2014
INVENTOR(S) : Lenk It is certified that error appears in the above-identified patent and that said Letters Patent is hereby corrected as shown below:

In the Claims

In Column 4, Line 44 (Line 23 of Claim 1) before the word "catalytic" please delete the word: "goes".

Signed and Sealed this
Tenth Day of March, 2015

Michelle K. Lee

Michelle K. Lee
*Deputy Director of the United States Patent and Trademark Office*